United States Patent [19]

Demuth

[11] 4,315,346

[45] Feb. 16, 1982

[54] CRUSH ROLL ARRANGEMENT FOR A CARD WEB

[75] Inventor: Robert Demuth, Wallisellen, Switzerland

[73] Assignee: Rieter Machine Works, Ltd., Winterthur, Switzerland

[21] Appl. No.: 129,973

[22] PCT Filed: Dec. 6, 1978

[86] PCT No.: PCT/EP78/00025

§ 371 Date: Aug. 24, 1979

§ 102(e) Date: Aug. 24, 1979

[87] PCT Pub. No.: WO79/00460

PCT Pub. Date: Jul. 26, 1979

[30] Foreign Application Priority Data

Dec. 30, 1977 [CH] Switzerland ..... 16274/77

[51] Int. Cl.[3] ..... D01G 15/96; B65H 27/00

[52] U.S. Cl. ..... 19/65 CR; 29/113 R

[58] Field of Search ..... 19/65 CR; 29/113 R, 29/125

[56] References Cited

U.S. PATENT DOCUMENTS

| | | | |
|---|---|---|---|
| 3,457,618 | 7/1969 | O'Neal et al. | 29/125 |
| 3,586,602 | 6/1971 | Schmidt | 29/113 R |
| 3,606,645 | 9/1971 | Vignon | 19/65 CR |
| 4,135,677 | 1/1979 | Warczak | 29/113 R |

FOREIGN PATENT DOCUMENTS

| | | | |
|---|---|---|---|
| 190837 | 8/1956 | Austria | 19/65 CR |
| 713884 | 10/1941 | Fed. Rep. of Germany | 19/65 CR |
| 904150 | 8/1954 | Fed. Rep. of Germany . | |
| 918676 | 9/1954 | Fed. Rep. of Germany . | |
| 595637 | 9/1957 | Italy | 19/65 CR |

*Primary Examiner*—Louis Rimrodt

*Attorney, Agent, or Firm*—Kenyon & Kenyon

[57] ABSTRACT

The present invention concerns a crush roll arrangement for a card web with two co-operating working rolls 6 and 10 as used, e.g. for crushing of seed and shell particles contained in a thin card web. At least one of the two rolls 6 and 10 is designed as a hollow member, the cylindrical sleeve 19 of which is pressurized inside and thus deforming in radial direction. By this deformation, which is counteracted by a second roll, the crushing pressure is generated between the working rolls 6 and 10. The sleeve 19 can, among other solutions, be of varying thickness along the longitudinal direction of the roll in such a manner that its radial deformation can be adapted in longitudinal direction along the working rolls 6 and 10.

28 Claims, 7 Drawing Figures

CRUSH ROLL ARRANGEMENT FOR A CARD WEB

The present invention concerns a crush roll arrangement for a card web with two co-operating working rolls, such as used in staple fibre spinning, particularly in processing natural fibres.

Crushing a very thin fiber web, such as is taken off e.g. from the doffer cylinder of a card, is carried out in order to reduce impurities still contained in the web by crushing them, particularly the harder seed and shell particles crushing is accomplished in such a manner that the detrimental effect of the crushed impurities in subsequent processing operations is less disturbing and that the elimination of the impurities from the fiber material is effected more easily.

In order to achieve good results using a crush roll arrangement of the above type, the uniformity of the crushing pressure generated over the whole working width of the rolls, which is of the order of 1 m, is of decisive importance. If the pressure is too low, the impurities are not crushed or are not crushed sufficiently, i.e. the crush roll arrangement does not achieve the desired effect, whereas excessive pressures cause damage to the fibre material. Many efforts thus have been made to achieve a uniform loading of the crush rolls. These have resulted in a number of proposed solutions, which however, are still unsatisfactory.

Thus, e.g. from German DT-PS No. 177 241 a crush roll arrangement for paper, textiles, wood, leather and similar materials, is known, in which, for achieving better smoothness, the axes of the cylindrical crush rolls are arranged at an angle with respect to each other. In a crossed arrangement of this type, a uniform pressure distribution can be achieved over the whole working width of the rolls in spite of the lateral loading of the rolls at the bearing support members. This known crush roll arrangement, however, shows substantial disadvantages: The use of pendulum bearings is required, which for setting the pressure are to be arranged adjustably. A design of this type, especially the crush roll drive mechanism, is complicated and expensive.

A further disadvantage is seen in that a certain crossing angle between the crush rolls permits uniform pressure distribution only if a pecisely determined load is applied to the bearing support members. If the bearing support members, e.g. are loaded excessively, the crush rolls are loaded at the edges, i.e. the pressure is higher toward the side portions of the rolls than at the centre. In oder to vary the pressure between the rolls—a uniform distribution being maintained—the crossing angle must also the varied. This, however, is a tedious operation which is difficult to control.

A further disadvantage of this known crush roll arrangement is that rolls which are bent in their axes, are subject to a constant reciprocating load, which requires, among other inconveniences, a corresponding bending work.

According to another proposed solution (German DT-PS No. 904 150) a uniform pressure distribution is to be effected using a crush roll arrangement with two working rolls which are supported over their length in such a manner that each working roll is supported by at least one loaded support member, the support member being designed preferentially as a member of constant strength.

In a further development of this idea (German DT-PS No. 918 676) it has become known to insert an elastic pressure transmitting member between the working roll and the support member. The disadvantage of this crush roll arrangement is that, under the full pressure force, the rotating cylindrical crush roll surface frictionally contacts the loaded support member or the pressure transmitting member, respectively. Thus, considerable energy losses and great danger of damage to the very susceptible roll surface prevails.

Furthermore, from U.S. Pat. No. 3 457 618, magnetic crush rolls for card webs are known. Such crush rolls consists of a thin tubular steel sleeve, inside which a plurality of permanent magnets are uniformly distributed over the whole width of the rolls, providing the magnetic flux required. Such crush rolls permit establishment of a uniform pressure distribution. They show the disadvantage, however, that their manufacture is very expensive and that the pressure cannot be varied.

It thus is the object of the present invention to propose a crush roll arrangement which eliminates the disadvantages of the known arrangements and in particular, permits achievement of a uniform and easily adjustable pressure distribution over the whole width of the rolls. Furthermore, the arrangement is to be of simple design, economically feasible and reliable.

These objectives are achieved with a crush roll arrangement for a card web with two co-operating working rolls, which are characterised in that at least one of the two rolls is designed as a hollow member, the substantially cylindrical sleeve of which is under the influence of a pressurized medium wetting the roll inside, and which is elastically deformable in a radial direction, and that the second roll is supported at such distance as to counteract the deformation of the deformable roll locally.

According to an alternative embodiment of the crush roll arrangement, the second roll also can be a hollow member which is elastically deformable radially toward the outside by a pressurized medium.

According to a further alternative embodiment, the roll inside available for the pressure medium is reduced by a rigid body. In this arrangement the rigid body in a particular embodiment can be designed as a cylinder on the outside surface of which the roll sleeve is supported if the medium is in an unpressurized state.

The invention is described in more detail in the following with reference to the accompanying drawings wherein:

FIG. 1 schematically illustrates a side view of the web take-off elements of a card;

FIG. 2 schematically illustrates a longitudinal sectional view of a crushed roll arrangement in accordance with the invention;

FIG. 3*a* illustrates a view taken on line A—A of FIG. 2;

FIG. 3*b* illustrates a view similar to FIG. 3*a* of a pressurized roll in accordance with the invention.

Figure 1:
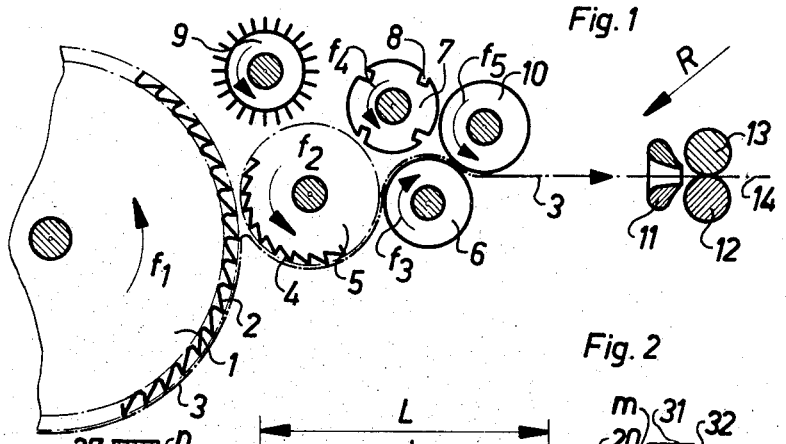

Referring to FIG. 1, a doffer cylinder 1 of a card transports on a point clothing 2, a fiber web 3 (indicated with a dash-dotted line) from below in the rotational direction indicated by arrow $f_1$ upward to a point where the web 3 is deflected from the doffer cylinder 1 by a point clothing 4 of a take-off roll 5 which rotates in the same direction (arrow $f_2$). The fiber web 3 contacts the substantially cylindrical smooth surface of a lower working roll 6. A transfer roll 7, which normally is provided with a structured surface (in FIG. 1 four suitably directed longitudinal grooves 8 are shown in the roll surface) ensures that the fiber web 3 is taken off the point clothing 4 and is deposited onto the surface of the lower working roll 6. Arrows $F_3$ and $f_4$ indicate the rotational direction of the rolls 6 and 7, the length of the arrows not indicating any relation with the actual roll speeds. A rotating brush 9 is provided above the take-off roll 5 to insure the elimination of any rest fibers from the point clothing 4 of the take-off roll 5.

The fiber web 3 is transported to the right, as viewed, by the lower working roll 6 and reaches a contact zone between the lower working roll 6 and an upper working roll 10 which forms a crushing line with roll 6 and rotates in the direction of arrow $f_5$. Here the web is subject to a crushing action known as such, in which the impurities contained in the fiber web 3, such as e.g. seed particles, sand particles, etc., are crushed. The fiber web 3 upon leaving the crushing line is e.g. condensed by a funnel 11, and is taken off by two rolls 12 and 13 in the form of a fiber sliver 14 (see also FIG. 2) and is transferred to a depositing device (not shown).

The position of the working rolls 6 and 10 as shown in FIG. 1 can be chosen within the scope of the present invention also in a different manner; in particular, e.g. in such a manner that the axes of both rolls are located in one vertical plane.

Figure 2:
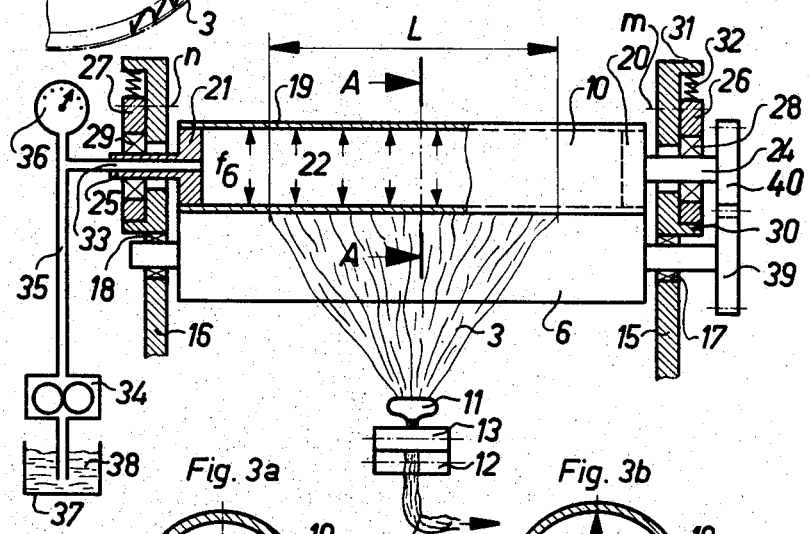

As shown in FIG. 2, the lower working roll 6 is a solid roll, the surface of which is substantially cylindrical, deviations from this shape being entirely possible within the scope of the present invention, as explained later on. The lower working roll 6 is rotatably, but not movably with respect to the room, supported in two anti-friction bearings 17 and 18 mounted each in a side member 15 and 16 of the card frame (not shown in more detail).

Figure 5:
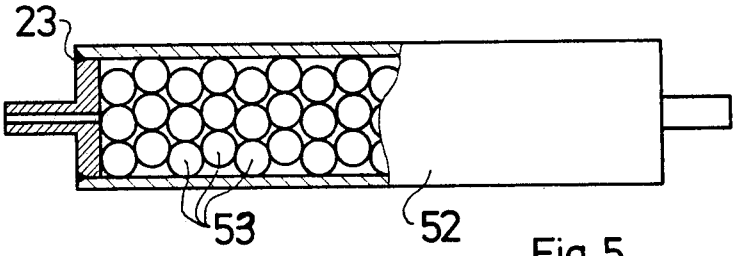
FIGS. 5 through 9 illustrate further alternative design examples of crush rolls, the crush rolls being shown without bearing members and loading elements.

The upper working roll 10 consists of a substantially cylindrical, thin sleeve 19 which is tightly sealed at each end by a cover 20 and 21 respectively, in such a manner that a pressure can be built up in the roll inside space 22. A suitable tight connection can be achieved, e.g. by welding (comp. FIG. 5 wherein the welding seam is designated 23). Also a tight press fit between the covers 20,21 and the sleeve 19, or a sliding fit with a tight seal (both not shown), can be considered.

Each cover 20 and 21 respectively, extends towards the outside on an axis 24 and 25 respectively, coaxial of the sleeve 19. The axes 24 and 25 are rotatably supported in two support members 26 and 27 each with an anti-friction bearing 28 and 29, respectively. The support members 26 and 27 in turn are slidably guided in the two frame side members 15 and 16 respectively, as shown in FIG. 2 wherein fixing screws (not shown) which adjustably connect the support members and the frame side members, are indicated schematically with their axes m and n. For this purpose, the side member 15 contains a stop 30 for the support member 26, which is pressed against the stop 30 by a pressure spring 32 arranged between an upper extension 31 of the side member 15 and the support member 26. The position of the stop 30 is chosen such that the whole force of the pressure spring 32 is taken up by the stop 30. A corresponding symmetrical arrangement is provided at the left hand side. In this case, the pressure spring 32 has no influence on the area pressure between the working rolls 6 and 10. This support arrangement provides a certain possibility of yielding to the rolls in case any non-crushable impurities are present in the fibre web 3 (FIG. 1), such as, e.g. a metal particle. In this case, the upper pressure roll 10 can be lifted, the pressure force of one or both pressure springs 32 being overcome, in such a manner that the uncrushable impurity can pass between the working rolls 6, 10 without damaging the roll surface, as would be the case with rigid support of both working rolls 6 and 10.

Furthermore it is noticed that bores are provided in the frame side elements 15 and 16 for the axes 24 and 25 of the working roll 10, the diameter of which bores exceeds the diameter of the axes, in such a manner that they penetrate the side frames with sufficient clearance.

The left-hand side axis 25 of the roll 10 contains a coaxial bore 33 which connects the roll inside space or interior 22 with a means for supplying a pressurized medium to the interior of the roll 10. This means includes a supply duct 35 which extends from a pump 34 by which the medium is pressurized. Between the rotating bore 33 and the stationary supply duct 35 a pressure-tight connection (not shown) is provided. To the supply duct 35 furthermore a pressure measuring device 36 is connected.

Figure 3A:
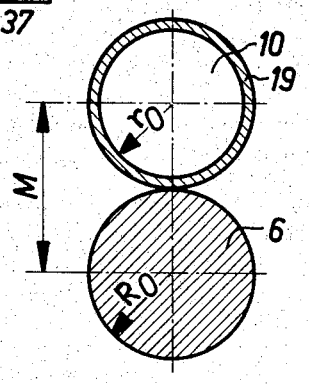

The pump 34 is supplied with the liquid 38 contained in reserve tank 37. Any compressible medium, however, e.g. a gas, can be used without difficulty, as the only requirement of the medium is that it is sufficiently pressurized. If a gaseous medium is used, a compressor can be used instead of a pump 34. The reserve tank 37 in this case is not required anymore. The radial arrows $f_6$ indicated on the roll inside space indicate the radial forces exerted by the medium onto the roll sleeve 19. Under the influence of these forces the sleeve 19 is deformed elastically over a distance $r_1$–$r_0$ in such a manner that the sleeve bulges outwards, as shown schematically in FIGS. 3*a* and 3*b*.

In its non-pressurized state the working roll 10 (FIG. 3*a*) the distance M between the centers of the working rolls 6 and 10 equals the sum of the radii $r_0$ and $R_0$ of both rolls 6 and 10, i.e. in the non-pressurized state the upper working roll 10 contacts the lower working roll 6 without load, or possible with a minimal load. The upper working roll 10 thus is not deformed, i.e. the cross-section remains circular. In order to achieve this, the axes of the rolls 6 and 10 with the corresponding support members can be supported in the most simple manner at fixed centers at a distance M, which is differing from the arrangement according to FIG. 2. The area pressure between the working rolls according to the invention is generated by the deformation of the working roll 10 caused by the pressure prevailing in the roll inside space 22, as clearly indicated in FIG. 3*b*.

Figure 3B:
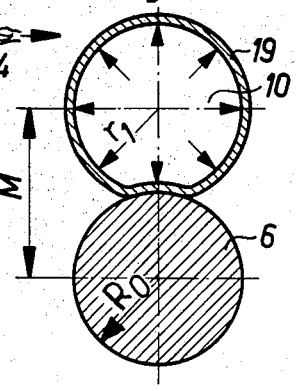

In FIG. 3*b* the increase of the diameter of the sleeve 19 of the upper working roll 10 under the influence of the pressure is shown. But as the distance M between the centers of the rolls 6 and 10 is maintained constant, the deformation of the roll 10 is locally impeded by the roll 6, as roll 10 necessarily contacts roll 6. Thus the area pressure required for crushing the fiber web (FIG. 1) is generated.

The uniformity of the area pressure along the whole length of the nip line between the two working rolls 6 and 10 furthermore can be ensured very reliably in the manner described in the following:

By, e.g. suitably choosing the contour of the sleeve 19 of the upper roll 10 and/or of the lower roll 6, an equalisation of the deformation influence which varies over the width of the rolls can be effected. In a roll 10, which in a nonloaded state is cylindrical, the lower, solid roll 6 can be shaped correspondingly concave. Furthermore, the effective width L (FIG. 2) of the pair of rolls, which corresponds to the width of the throughpassing web, can be chosen smaller than the total width of the rolls. Thus the influence of the radially not deformable roll end portions can be eliminated to a large extent.

The two working rolls 6 and 10 are connected by two gears 39 and 40 for drive purposes. As the axes of the rolls 6 and 10 are maintained parallel at all times and as the center distance M is maintained constant at all times, optimum conditions are ensured for the pair of gears 39,40.

Figure 4:
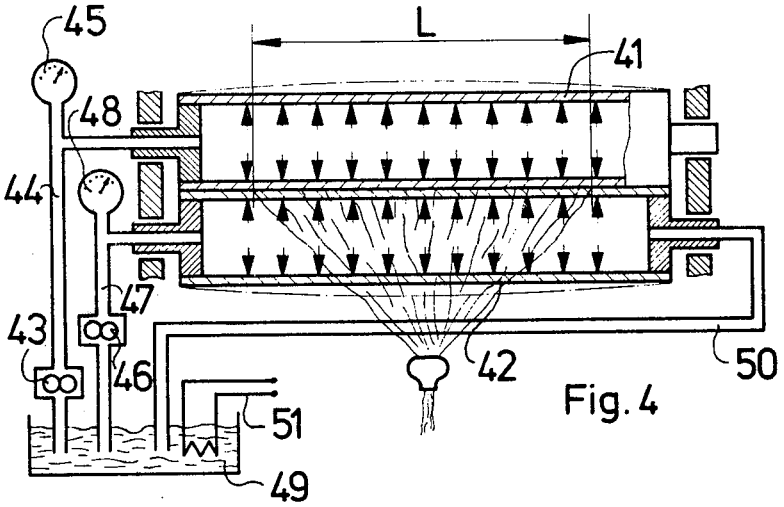
FIG. 4 illustrates an alternative embodiment of the crush roll arrangement in a longitudinal section.

In FIG. 4 an alternative of the crush roll arrangement according to FIG. 2 is shown, differing from the latter mainly in that both working rolls are designed as hollow members deformable in radial direction under the influence of a pressurized medium acting on the roll inside spaces.

In FIG. 4 an upper working roll 41 and a lower working roll 42 are provided, designed in the same manner as the upper working roll 10 according to FIG. 2. The diameters of the rolls 41 and 42 can be different however. Also in this arrangement of the crush rolls, the effective roll width L is smaller than the total width of the rolls 41 and 42, in which a manner that the influence of the roll end portions on the pressure distribution over the nip line is eliminated to a large extent. Furthermore, the pressure prevailing in each roll differs. For this purpose, the upper working roll 41 is pressurized by means of a first pump 43 via a supply duct 44. By a second pump 46 and via a supply duct 47 on the other hand, the lower working roll 42 is pressurized and thus is deformed. The pressures applied are controlled by the two pressure masuring instruments 45 and 48.

Both pumps 43 and 46 are supplied with a liquid contained in a common reserve tank 49. The pumps 43 and 46, however, also can be supplied from separate reserve tanks with the same liquid or with different liquids.

In FIG. 4 also the possibility is shown of influencing the function of one of the working rolls by increasing or by lowering the temperature of the medium. This arrangement can prove advantageous in special applications of crush rolls, if e.g. the impurities can be rendered brittle or less sticky by lowering their temperature. For this purpose, the lower working roll 42 is provided with a back-flow duct 50 connecting the roll inside space with the reserve tank 49. The liquid supplied by the pump 46 thus can flow through the roll 42. The liquid is heated, or chilled respectively, by a heat exchanger 51 provided in the circulation circuit e.g. in the reserve tank.

In FIGS. 5 through 9 further alternative design examples of working rolls are shown which can be applied within the scope of the present invention. As in all these examples the pairs of rolls are supported in the same manner as described with reference to the examples shown in FIGS. 2 and 4, the further description can be limited to the actual design of the rolls.

In FIG. 5 a working roll 52 is shown, in which the roll inside space available for the pressure medium is reduced by spherical rigid bodies 53 arranged in the roll inside space. Any other shape desired of the bodies also can be considered, from powdery material to one solid cylindrical body filling the space partially or wholly. By reducing the room available for the pressure medium, a reduction of the total volume of the medium required is achieved. Considering the fact that any medium is of a certain compressability, this arrangement proves advantageous, as it ensures better constancy of the pressure maintained inside the roll.

Figure 6:
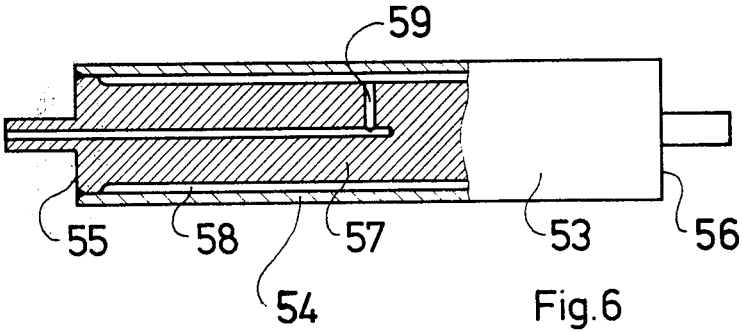

The working roll 53 shown in FIG. 6 also consists, as all design examples according to the invention, of a sleeve 54 deformable in radial direction, which at both face surfaces 55 and 56, is welded to a cylindrical body 57. Between the sleeve 54 and the cylindrical body 57 an annular gap or space 58 extends over almost the full width of the sleeve 54, into which gap 58, the supply duct 59 for the pressure medium merges.

Figure 7:
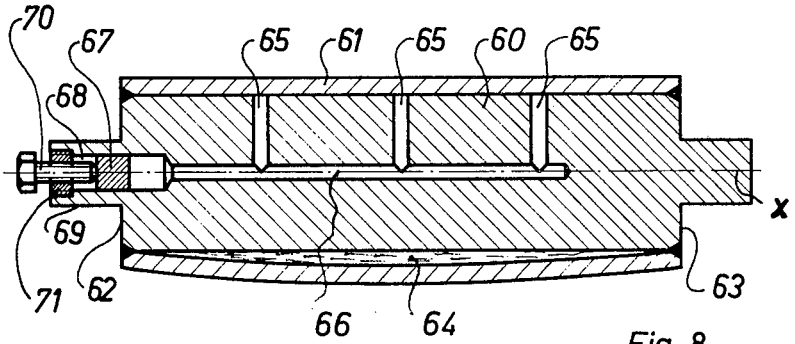

In FIG. 7 a further alternative design example is shown of the working rolls according to FIG. 6, in which a sleeve 61 in the non-pressurized state of the medium contacts the outside surface of a cylindrical body 60, the diameter of which corresponds to the sleeve inside diameter. In FIG. 7 the upper half of the roll is shown in a non-pressurized state, whereas the lower half of the roll (below the centre line x) is shown in a pressurized state.

As different from the roll according to FIG. 6 no annular gap prevails between the face sides 62 and 63, but the cylindrical body 60 fills the whole roll inside determined by the sleeve 61 in the non-pressurized state. This alternative design example presents the advantage that the sleeve 61 in the non-pressurized state is supported and thus is aligned by the very massive, precise cylindrical body 60.

A plurality of connecting ducts 65 connect the central medium supply bore 66 with a cylindrical periphery of the cylindrical body 60. In this manner, the distribution of the pressure medium throughout a gap 64 between the sleeve 61 and the cylindrical body 60 is favoured. The same effect can be achieved by structuring the surface of the cylindrical body 60, e.g. by grooves.

In this design example, furthermore, the application of an outside pressure source is eliminated. The pressure inside the roll simply is established by providing an adjustable pressure piston 67 which displaces the medium in the roll inside. The piston 67 guided in a bore 68 of a hub 69 and provided with a suitable seal (not shown) if needed, is pressed against the liquid, filling the roll inside space by means of a set screw 70 which is screwed into a corresponding threaded nut 71 of the hub 69. The advantage of this design example is seen in the utmost design simplicity. The use of particularly pressure resistant mediums, of course, is required in this example, such that the pressure and thus also the deformation of the sleeve 61 is maintained constant over time.

The uniformity of the area pressure between the two working rolls can be achieved also in a different manner, namely in that the face covers 73 and 74 (FIG. 8) are centrally connected mutually by a shaft 76 forming two hubs 77 and 78 as bearing positions for the working rolls outside the face covers. As shown, a sleeve 72 is welded to two covers 73, 74 via welding seams 75 and an inside space is formed between the sleeves 72 and covers 73, 74 which is subdivided into individual chambers 81 by ringshaped intermediate walls 79 and 80. In this arrangement the intermediate walls 79 and 80 are designed in such a manner that they can yield to a radial deformation of the sleeve 72, whereas they are pressure-tight at the face side. Suitably chosen, concentrically, annularly ondulated sheet metal plates, e.g. can fulfill these requirements.

Figure 8:
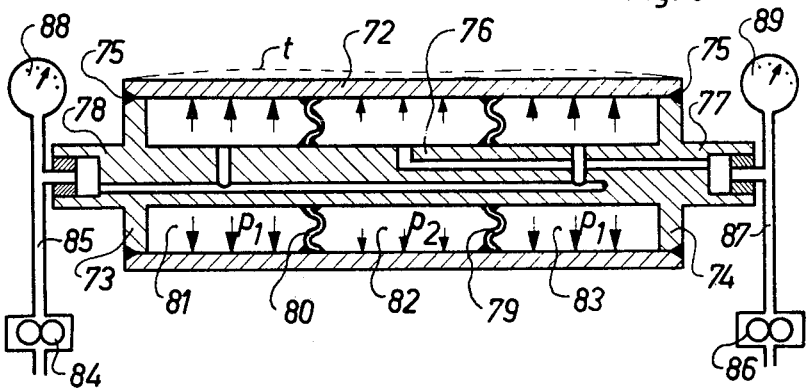

Using suitable supply ducts, the individual chambers 81, 82 and 83 can be pressurized. A pump 84 via a supply duct 85 pressurizes the chambers 81 and 83 at the pressure $p_1$, whereas the chamber 82 is pressurized by a second pump via a supply duct 87 at the pressure $p_2$. The pressure $p_1$ and $p_2$ respectively, can be checked by two pressure measuring instruments 88 and 89 respectively. By suitably choosing the pressures $p_1$ and $p_2$, the shape of the sleeve surface in a loaded state (indicated by the broken line t) can be influenced. Normally the pressure $p_1$ will be chosen greater than the pressure $p_2$, as indicated in FIG. 8, by the different length of the arrows indicating the pressure.

Figure 9:
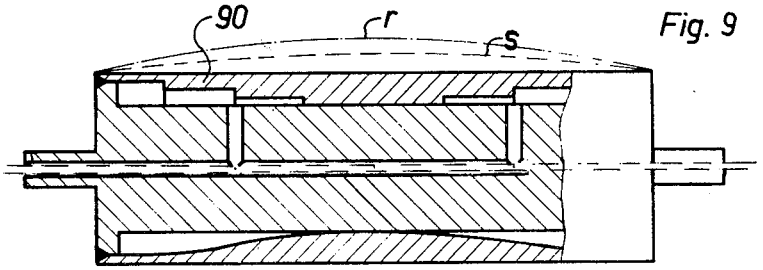

In FIG. 9 the equalisation of the area pressure is achieved by choosing varying sleeve thicknesses over the roll width. In the upper half of FIG. 9, e.g. the sleeve 90 of the roll is varied in steps towards the middle, whereas in the lower half, the sleeve thickness gradually increases and decreases.

By such variations in thickness, which in FIG. 9 are shown exaggerated for better clarity, the resistance to deformation of the sleeve 90 can be influenced along the width of the roll, in such a manner that in turn the shape of the sleeve in a loaded state can be adpated to the requirements as desired. Thus, e.g. the dash-dotted line r indicates the outline of a sleeve 90 of constant thickness. The broken line s, on the other hand, indicates the deformation of a sleeve 90, the thickness of which is varied in steps over the roll width.

Furthermore, the various measures proposed for equalisation of the area pressure between the working rolls of a crush roll arrangement can be combined for achieving optimum results. Thus, e.g. a working roll can be provided with a sleeve of varying thickness and can be subdivided in individual chambers.

The most important advantages of the crush roll arrangement are:

(a) Parallel instead of crossed arrangement of the working rolls, such that any card can be equipped with a crush roll arrangement, without complicated bearing problems to be overcome, and that the area pressure between the working rolls can be adapted in a simple manner, the working rolls being maintained parallel.

(b) Simple and economically feasible design, ensuring highly reliable crushing action.

(c) Easy retrofitting on existing cards, as no particular requirements are imposed for the bearing arrangement.

(d) Good influenciability and optimum uniformity of the area pressure along the width of the roll.

(e) Easy change from operation with fiber web crushing action to operation without such action. For this purpose it is sufficient to release the pressure inside the working roll. This advantage is of utmost importance is practical operation, as with each change in the material to be processed the question of suitability is to be re-checked anew.

I claim:

1. Crush roll arrangement for a card web with two cooperating working rolls characterised in that at least one of the two working rolls is designed as a hollow member, the substantially cylindrical sleeve of which is adapted to be under the influence of a pressurized medium on the roll inside and which is elastically deformable in radial direction, and that a second roll is supported at such distance to counteract the deformation of the deformable roll locally.

2. Crush roll arrangement according to claim 1, characterised in that the second roll also is a hollow member, which is elastically deformable in radial direction towards the outside.

3. Crush roll arrangement according to claim 1, characterised in that the inside space available for the pressure medium is reduced by a rigid body arranged therein.

4. Crush roll arrangement according to claim 3, characterised in that the rigid body is a cylinder.

5. Crush roll arrangement according to claim 4, characterised in that the sleeve in the non-pressured state of the medium contacts the outside surface of the cylinder.

6. Crush roll arrangement according to claim 1, characterised in that the medium is a liquid.

7. Crush roll arrangement according to claim 1, characterised in that the medium is a gas.

8. Crush roll arrangement according to claim 1, characterised in that the inside space is connected via a pressure duct with an external pressure source arranged outside the roll.

9. Crush roll arrangement according to claim 1, characterised in that the inside space is provided with an adjustable pressure piston displacing the medium.

10. Crush roll arrangement according to claim 6 or 9, characterised in that the liquid is as incompressible as possible.

11. Crush roll arrangement according to claim 1, characterised in that a heat exchanger for the medium is provided.

12. Crush roll arrangement according to claim 1, characterised in that the roll inside space is sub-divided in individual chambers, at least one of which chambers is filled with pressure medium.

13. Crush roll arrangement according to claim 1, characterised in that a plurality of adjacent chambers filled at different medium pressures are provided.

14. Crush roll arrangement according to claim 1, characterised in that the sleeve in longitudinal direction is of varying thickness.

15. Crush roll arrangement according to claim 1, characterised in that the working rolls are pressed against each other at their end positions by means of force accumulators.

16. Crush roll arrangement according to claim 15, characterised in that both force accumulators each act against a fixed stop which takes up the full pressure force of the force accumulator.

17. Crush roll arrangement according to claim 1, characterised in that the axes of the working rolls are arranged at fixed centres mutually.

18. A crush roll arrangement for a card web comprising a pair of rolls for crushing impurities in a web passing therebetween, said rolls being rotatably mounted on respective longitudinal axes disposed at a fixed distance from each other during operation of the arrangement, at least one of said rolls having an outer radially deformable cylindrical sleeve and a space within said sleeve to receive a pressurized medium for radial deformation of said sleeve to increase the diameter of said sleeve whereby said sleeve deforms against the other of said rolls to define an area of pressure therebetween.

19. A crush roll arrangement as set forth in claim 18 wherein said one roll includes a cylindrical body within said sleeve and said space is an annular gap between said sleeve and said body.

20. A crush roll arrangement for a card web comprising a pair of rolls for crushing impurities in a web passing therebetween, said rolls being rotatably mounted on respective longitudinal axis disposed at a fixed distance from each other during operation of the arrangement, at least one of said rolls having an outer radially deformable cylindrical sleeve, a cylindrical body supporting said sleeve on a periphery of said body and a plurality of ducts in said body communicating with said periphery of said body for introducing a pressurized medium between said body and said sleeve for radial deformation of said sleeve to increase the diameter of said sleeve whereby said sleeve deforms against the other of said rolls to define an area of pressure therebetween.

21. A crush roll arrangement for a card web comprising a pair of rolls for crushing impurities in a web passing therebetween, said rolls being rotatably mounted on respective longitudinal axis disposed at a fixed distance from each other during operation of the arrangement, at least one of said rolls being an outer radially deformable cylindrical sleeve; and means for supplying a pressurized medium to said one roll to radially deform said sleeve whereby said sleeve increases in diameter and deforms against the other of said rolls to define an area of pressure therebetween.

22. A crush roll arrangement as set forth in claim 18 or 20 or 21 wherein said other roll is hollow and elastically deformable in an outward radial direction.

23. A crush roll arrangement as set forth in claim 18 or 20 or 21 wherein said one roll has a rigid body within said space to reduce the space for the pressurized medium.

24. A crush roll arrangement as set forth in claim 18, or 20 or 21 wherein said one roll has an adjustable pressure piston therein for displacing the pressurized medium from said space.

25. A crush roll arrangement as set forth in claim 18 or 20 or 21 which further comprises a heat exchanger for heating the pressurized medium in said one roll.

26. A crush roll arrangement as set forth in claim 18 or 20 or 21 wherein said space in said one roll is subdivided into individual chambers with at least one chamber filled with the pressurized medium.

27. A crush roll arrangement as set forth in claim 18 or 20 or 21 wherein said sleeve is of varying thickness in the longitudinal direction thereof.

28. A crush roll arrangement as set forth in claim 18 or 20 or 21 which further comprises force accumulators at each end of said rolls for pressing said rolls against each other.

* * * * *

UNITED STATES PATENT AND TRADEMARK OFFICE

CERTIFICATE OF CORRECTION

PATENT NO. : 4,315,346

DATED : February 16, 1982

INVENTOR(S) : Robert Demuth

It is certified that error appears in the above—identified patent and that said Letters Patent is hereby corrected as shown below:

Column 1, line 25 change "fibre" to --fiber--.
Column 1, line 50 change "oder" to --order--.
Column 1, line 52 change "the" to --be--.
Column 2, line 11 change "consists" to --consist--.
Column 3, line 51 change "each with" to --via--.
Column 4, line 25 change "the" to --a--; line 26, after "in" insert --a--.
Column 4, line 38 change "its" to --the--; after "state" insert --of--.
Column 5, line 27 change "which" to --such--.
Column 5, line 36 change "masuring" to --measuring--.

Signed and Sealed this

*Seventeenth* Day of *August 1982*

[SEAL]

*Attest:*

GERALD J. MOSSINGHOFF

*Attesting Officer* *Commissioner of Patents and Trademarks*